US011834232B2

(12) United States Patent
Li et al.

(10) Patent No.: US 11,834,232 B2
(45) Date of Patent: Dec. 5, 2023

(54) PUSH TYPE CUP LID AND CUP

(71) Applicant: NINGBO LISI HOUSEWARE CO., LTD., Ningbo (CN)

(72) Inventors: Lixin Li, Ningbo (CN); Yongning Zhou, Ningbo (CN); Yaxue Jin, Ningbo (CN)

(73) Assignee: NINGBO LISI HOUSEWARE CO., LTD., Ningbo (CN)

( * ) Notice: Subject to any disclaimer, the term of this patent is extended or adjusted under 35 U.S.C. 154(b) by 20 days.

(21) Appl. No.: 17/647,357

(22) Filed: Jan. 7, 2022

(65) Prior Publication Data

US 2023/0219723 A1 Jul. 13, 2023

(51) Int. Cl.

| | |
|---|---|
| ***B65D 47/08*** | (2006.01) |
| ***B65D 53/02*** | (2006.01) |
| ***A45F 3/18*** | (2006.01) |
| ***A47G 19/22*** | (2006.01) |

(52) U.S. Cl.

CPC ..... *B65D 47/0871* (2013.01); *A45F 3/18* (2013.01); *A47G 19/2272* (2013.01); *B65D 53/02* (2013.01)

(58) Field of Classification Search

CPC ..... B65D 47/0871; B65D 53/02; A45F 3/18; A47G 19/2272

USPC ..... 220/254.3, 254.5, 715

See application file for complete search history.

(56) References Cited

U.S. PATENT DOCUMENTS

| | | | | |
|---|---|---|---|---|
| 5,427,271 | A * | 6/1995 | Wang | A47G 19/2272 220/255 |
| 8,978,923 | B2 * | 3/2015 | George | B65D 43/0225 215/311 |
| 11,472,611 | B1 * | 10/2022 | Hove | B65D 41/04 |
| 2016/0106241 | A1 * | 4/2016 | Wong | B65D 47/32 220/254.5 |
| 2017/0081092 | A1 * | 3/2017 | Gregory | B65D 47/249 |
| 2017/0327282 | A1 * | 11/2017 | Choltco-Devlin | A47G 19/2272 |

FOREIGN PATENT DOCUMENTS

| | | |
|---|---|---|
| CN | 208915803 U | 5/2019 |

* cited by examiner

*Primary Examiner* — James N Smalley

(74) *Attorney, Agent, or Firm* — INNOVATION CAPITAL LAW GROUP, LLP; Vic Lin

(57) ABSTRACT

The present invention provides a push type cup lid, which has a lid body, provided with a water outlet; a flip-top lid for covering the water outlet, the flip-top lid being rotatably connected with the lid body; a sealing assembly for plugging the water outlet, the sealing assembly being movably connected with the lid body; and a button arranged on the lid body in a pressed manner, both the sealing assembly and the flip-top lid being in linked connection with the button. The present invention has the beneficial effects that according to the cup lid, the water outlet is plugged by the sealing assembly and the water outlet is further covered by the flip-top lid, so that the reliability of the cup lid which is closed is ensured; when it is opened, the sealing assembly and the flip-top lid can be opened simultaneously by pressing the button.

17 Claims, 13 Drawing Sheets

PUSH TYPE CUP LID AND CUP

BACKGROUND OF THE INVENTION

1. Technical Field

The present invention belongs to the technical field of water drinking or beverage drinking containers, and relates to a push type cup lid, and further relates to a cup provided with the push type cup lid.

2. Description of Related Art

A cup is a beverage-drinking or water-drinking container. The cup is provided with a cup lid, and water can be taken by opening the cup lid. At present, there are many cup lids of push type opening structures, i.e., water outlets in the cup lids can be opened by pressing buttons.

For example, the utility model with the application No. CN201820965011.7 discloses a lid of a container and an internal bolt body thereof. The lid includes a lid main body, a lid body and an internal bolt body. The internal bolt body is detachably mounted in a hollow portion of the lid main body via a fastener and a clamping portion, and the fastener is an outward protruding portion on an outer side surface of the internal bolt body. The clamping portion is an elastic part which is on the outer side surface below an outward flange of the internal bolt, is integrally formed on the opposite side of the fastener and extends upwards. An inner side surface of the lid main body is provided with a fastener receiving portion. The opposite side of the receiving portion of the fastener on the inner side surface of the lid main body is provided with a receiving portion of the inward concave clamping portion.

A current cup lid is usually structured such that a flip-top lid is provided with a sealing element. When the flip-top lid covers the water outlet, the sealing element seals the water outlet. However, the structure has a certain using risk. Once the flip-top lid is loosened, water may be leaked.

BRIEF SUMMARY OF THE INVENTION

Aiming at the above-mentioned problems in the prior art, the objective of the present invention is to provide a push type cup lid and to further provide a cup provided with the push type cup lid.

The objective of the present invention be realized by the technical schemes as follows:

A push type cup lid, comprising:

a lid body provided with a water outlet;

a flip-top lid for covering the water outlet, the flip-top lid being rotatably connected with the lid body;

a sealing assembly for plugging the water outlet, the sealing assembly being movably connected with the lid body; and a button, the button being arranged on the lid body in a pressed manner, both the sealing assembly and the flip-top lid being in linked connection with the button, when the button is not pressed, the flip-top lid covering the water outlet and the sealing assembly plugging the water outlet, and when the button is pressed, the flip-top lid turning back and the sealing assembly being separated from the water outlet. Preferably, the sealing assembly comprises a connecting rod in linked connection with the button and a sealing seat plugging the water outlet, wherein the connecting rod is movably connected with the lid body, the sealing seat is connected with the connecting rod, and when the button is pressed, the button drives the sealing seat to be separated from the water outlet via the connecting rod.

Preferably, the lid body is provided with a first mounting cavity, and the connecting rod is assembled in the first mounting cavity and moves along an axial direction of the first mounting cavity.

Preferably, the lid body is further provided with a second mounting cavity, and the button is assembled in the second mounting cavity and moves along a direction inclined to a moving direction of the connecting rod.

Preferably, the connecting rod is provided with a bevel portion, the button is provided with a push block, the push block is in abutting connection with the bevel portion, and when the button is pressed along an inclination direction, the push block pushes the bevel portion, so that the connecting rod descends vertically.

Preferably, one end of the sealing seat is provided with a sealing element located under the water outlet, the other end of the sealing seat is provided with a connecting plate extending towards a direction of the connecting rod, the connecting plate is fixedly connected with the connecting rod, and the sealing element plugs the water outlet.

Preferably, the flip-top lid is provided with an articulated shaft, the articulated shaft is connected with the lid body, and the flip-top lid can rotate around the articulated shaft so as to open the water outlet or cover the water outlet.

Preferably, the button is provided with a first hook, the flip-top lid is provided with a second hook, when the flip-top lid covers the water outlet, the first hook hooks the second hook to limit turning back of the flip-top lid, and when the button is pressed, the first hook loosens the second hook so as to relieve locking of the flip-top lid.

Preferably, the articulated shaft is provided with a torsional spring connected with the lid body, and when the first hook loosens the second hook, the torsional spring drives the flip-top lid to rotate around the articulated shaft so as to open the water outlet.

Preferably, a connecting rod reset spring for jacking the connecting rod is mounted between the connecting rod and the lid body, and one end of the connecting rod reset spring is in abutting connection with the connecting rod and the other end thereof is in abutting connection with the lid body.

Preferably, a peripheral surface of the lid body is provided with a strip-type groove, the strip-type groove is internally provided with a stop dog capable of sliding along the strip-type groove, the connecting rod is provided with a baffle extending towards a direction of the peripheral surface of the lid body, the baffle is provided with a notch portion matched with the stop dog, the stop dog can slide to a locking position in abutting connection with the baffle or the stop dog can slide to an unlocking position corresponding to the notch portion, and when the stop dog is located in the locking position, the stop dog limits movement of the button via the connecting rod.

Preferably, the sealing assembly further comprises a connecting screw, the connecting rod is provided with a threaded hole, and the connecting screw is connected with the threaded hole and abuts against the connecting plate so as to lock the connecting rod and the connecting plate.

Preferably, the lid body is provided with a guide hole, the connecting rod is provided with a guide portion, and the guide portion penetrates through the guide hole movably.

Preferably, the lid body is provided with a button mounting seat, the second mounting cavity is located in the button mounting seat, and the button is assembled in the button mounting seat.

Preferably, the second mounting cavity is provided with a button reset spring for jacking the button, the lid body is provided with a fixed plate located at a bottom of the second mounting cavity, and one end of the button reset spring is in abutting connection with the button and the other end thereof is in abutting connection with the fixed plate.

Preferably, a position where the connecting plate and the connecting rod are matched is provided with a first seal ring. Preferably, the guide portion is sleeved with a second seal ring located between the guide portion and the guide hole. Secondarily, provided is a cup, including:

a cup body provided with a cup cavity, wherein the push type cup lid is connected with the cup body and covers the cup cavity.

Preferably, a rim of the cup of the cup body is provided with an external thread, the lid body is provided with an internal thread, and the lid body is detachably connected with the cup body via the internal thread and the external thread.

Preferably, the lid body is internally provided with a third seal ring, and the third seal ring is in abutting connection with an end port of the cup body.

Compared with the prior art, the present invention has the following beneficial effects:

1. When the cup lid is in a closed state, the sealing element can plug the water outlet from bottom to top, and the flip-top lid can cover the upper side of the water outlet, so that the upper side and the lower side of the water outlet may be sealed. The cup lid may obtain a better insulation effect due to the double structure of plugging the water outlet. Furthermore, it may be further reliably ensured that the water outlet does not leak water;

2. Both the sealing assembly and the flip-top lid are in linked connection with the button, the button may be pressed, and the sealing assembly and the flip-top lid may act simultaneously by pressing one button, so that it is more convenient to use, and the cup lid may be opened with a single hand;

3. The connecting rod may drive the sealing seat to move vertically during movement. When the connecting rod ascends along a vertical direction, the sealing seat may ascend and abut against the lower side of the water outlet. When the connecting rod descends along the vertical direction, the sealing seat may descend vertically to be separated from the water outlet quickly, so that the water outlet is communicated with the cup cavity of the cup body;

4. The first mounting cavity is internally provided with the connecting rod reset spring, so that the sealing seat may be reset automatically when the button is loosened, and therefore, the water outlet is sealed. The connecting rod reset spring may further apply an acting force to the sealing seat towards the water outlet through the connecting rod;

5. As the sealing seat is located in the lid body to obstruct and plug the water outlet from bottom to top, it is hidden in structure and relatively good in sealing effect. No matter how the cup flips, the water outlet may be tightly plugged, which is not easily interfered by an external force or an external factor;

6. The moving direction of the button which is pressed is inconsistent with the moving direction of the connecting rod because besides driving the connecting rod to act, the button further needs to unlock the flip-top lid. If the moving direction of the button is arranged to move obliquely, it is favorable for the button to trigger the connecting rod and the flip-top lid to act at the same time;

7. In order to flip the unlocked flip-top lid automatically, the articulated shaft is specially provided with the torsional spring, two ends of the torsional spring are in abutting connection with the flip-top lid and the lid body respectively, so that once the button is pressed, the first hook and the second hook are separated, and the torsional spring may drive the flip-top lid to flip automatically; and 8. The connecting rod and the sealing seat on the sealing assembly may be screwed out via the connecting screw, so that it may be quick and convenient to detach the connecting rod and the sealing seat, and therefore, it is convenient to clean the sealing assembly.

Figure 1:
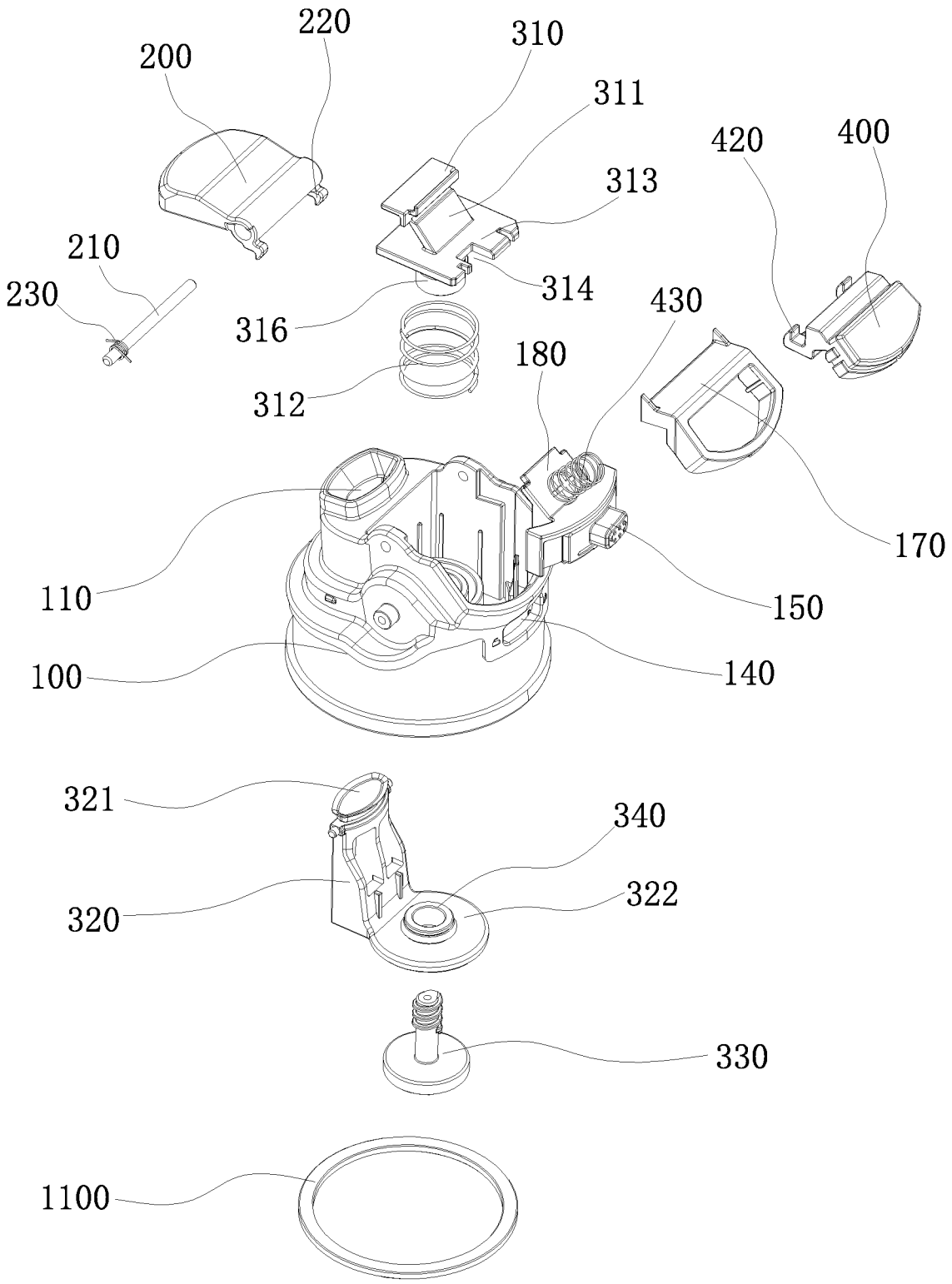
FIG. 1 is an exploded view of a structure of a push type cup lid of the present invention.
Figure 2:
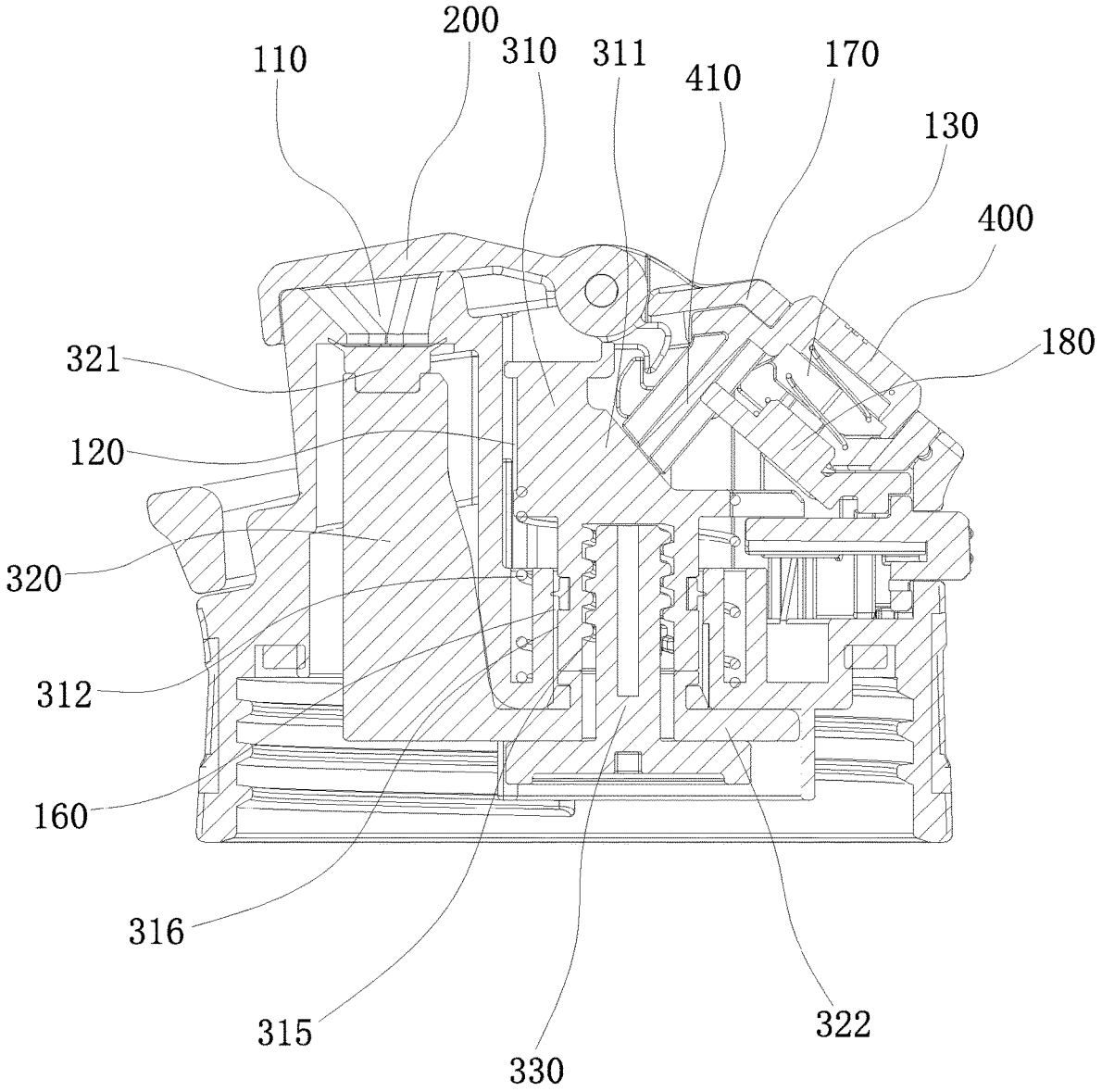
FIG. 2 is a structural schematic diagram of a push type cup lid of the present invention in a closed state.
Figure 3:
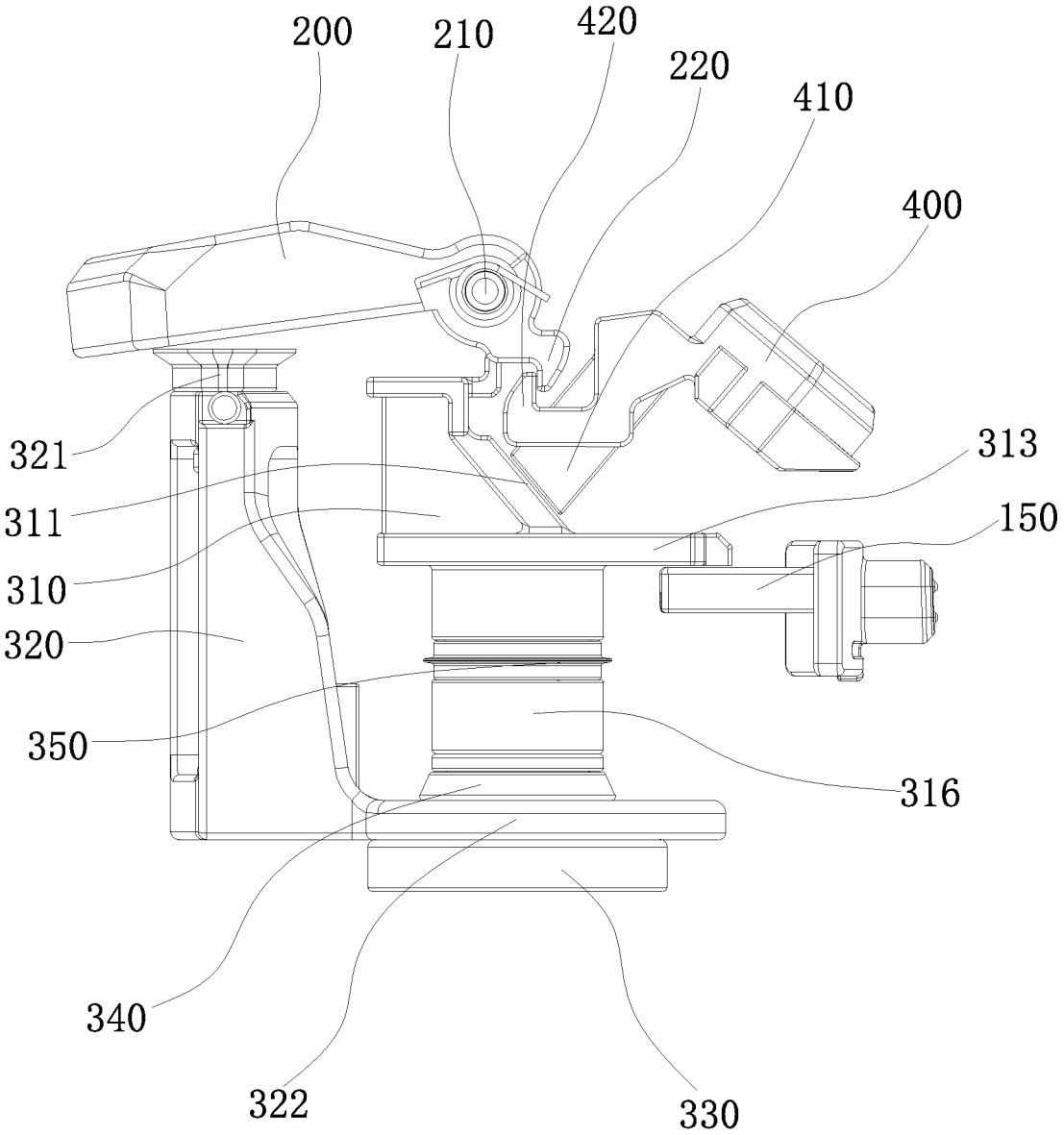
FIG. 3 is a structural schematic diagram of a flip-top lid and a sealing assembly of the present invention in a closed state.
Figure 4:
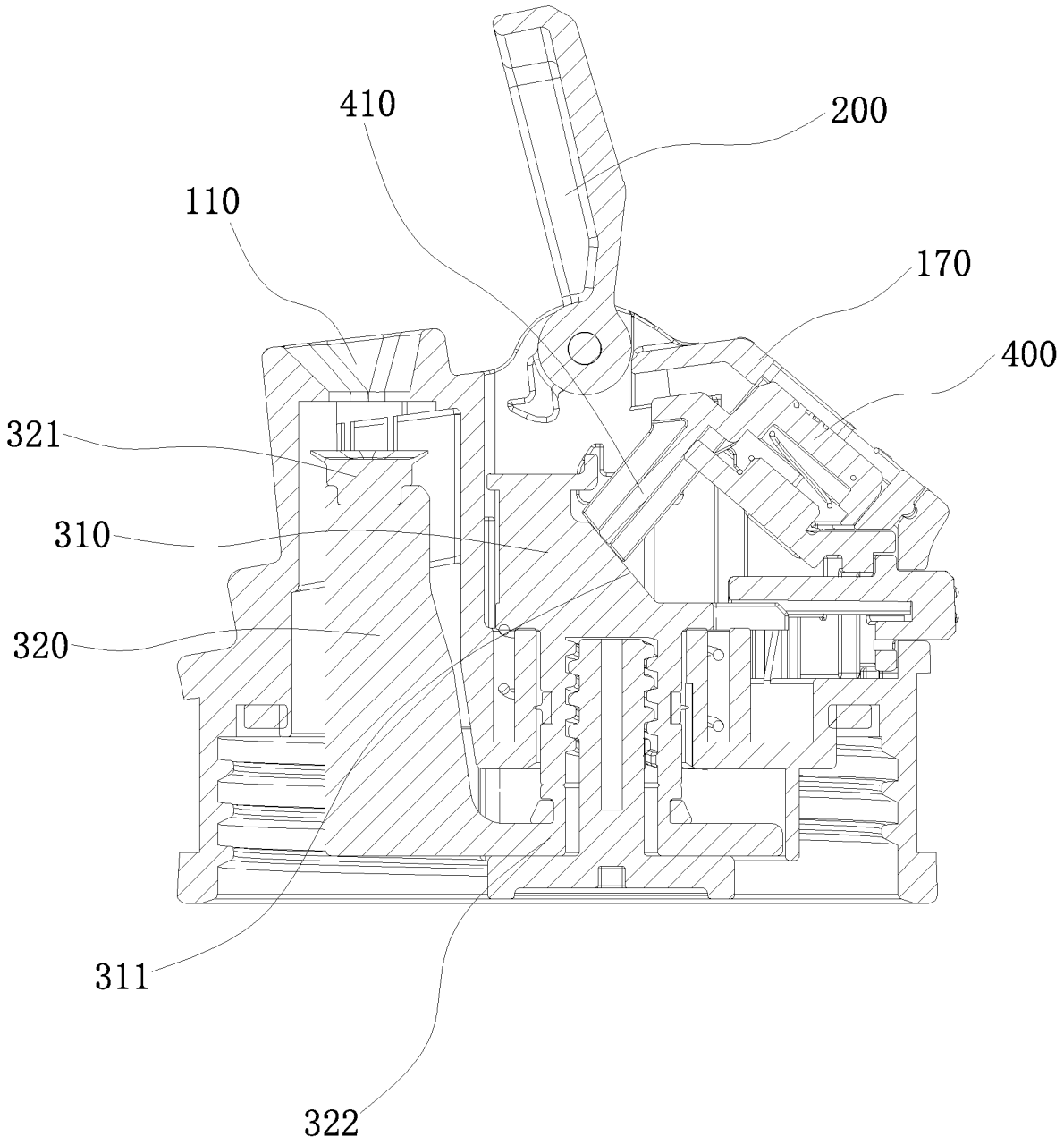
FIG. 4 is a structural schematic diagram of a push type cup lid of the present invention in an opened state.
Figure 5:
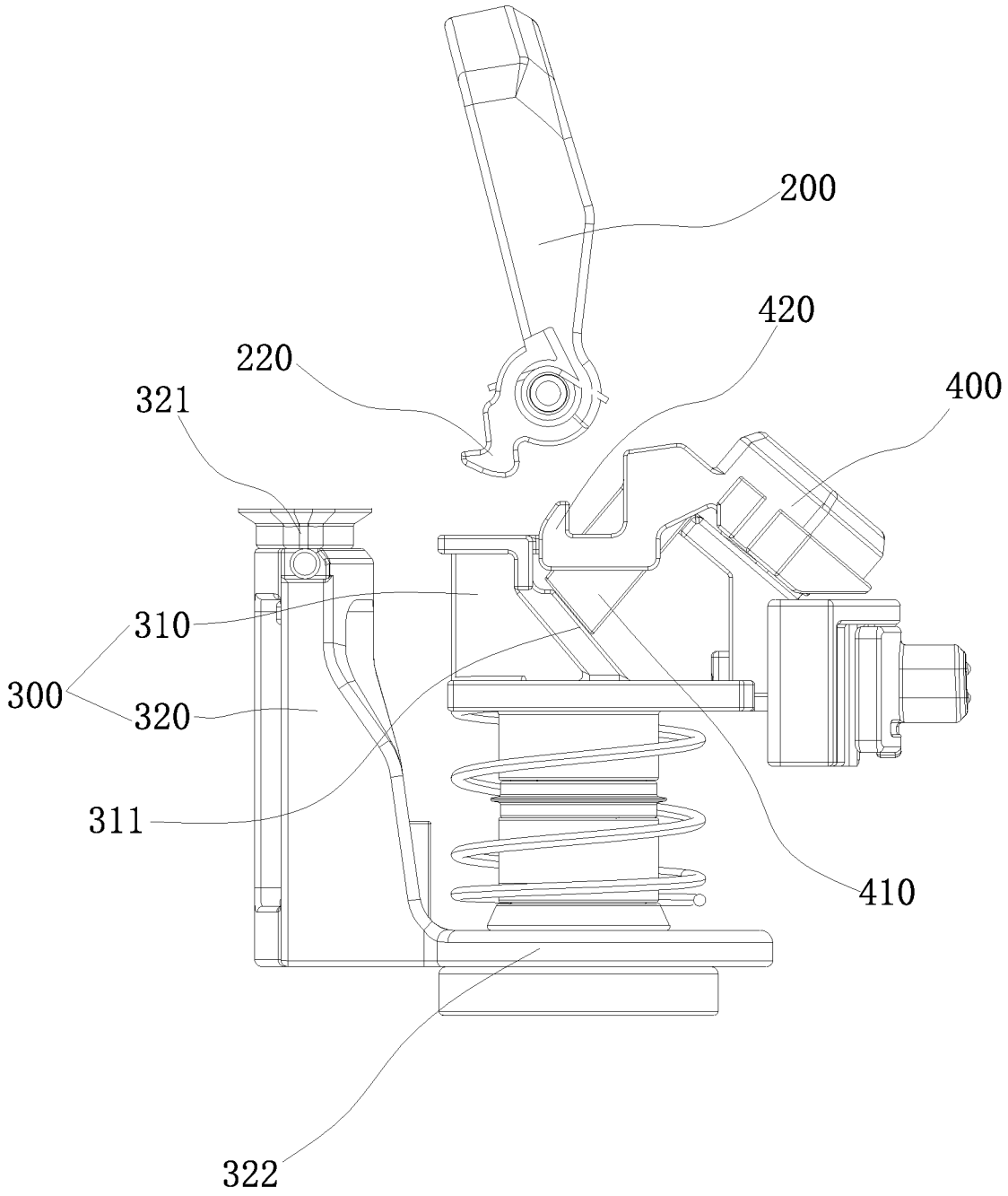
FIG. 5 is a structural schematic diagram of a flip-top lid and a sealing assembly of the present invention in an opened state.
Figure 6:
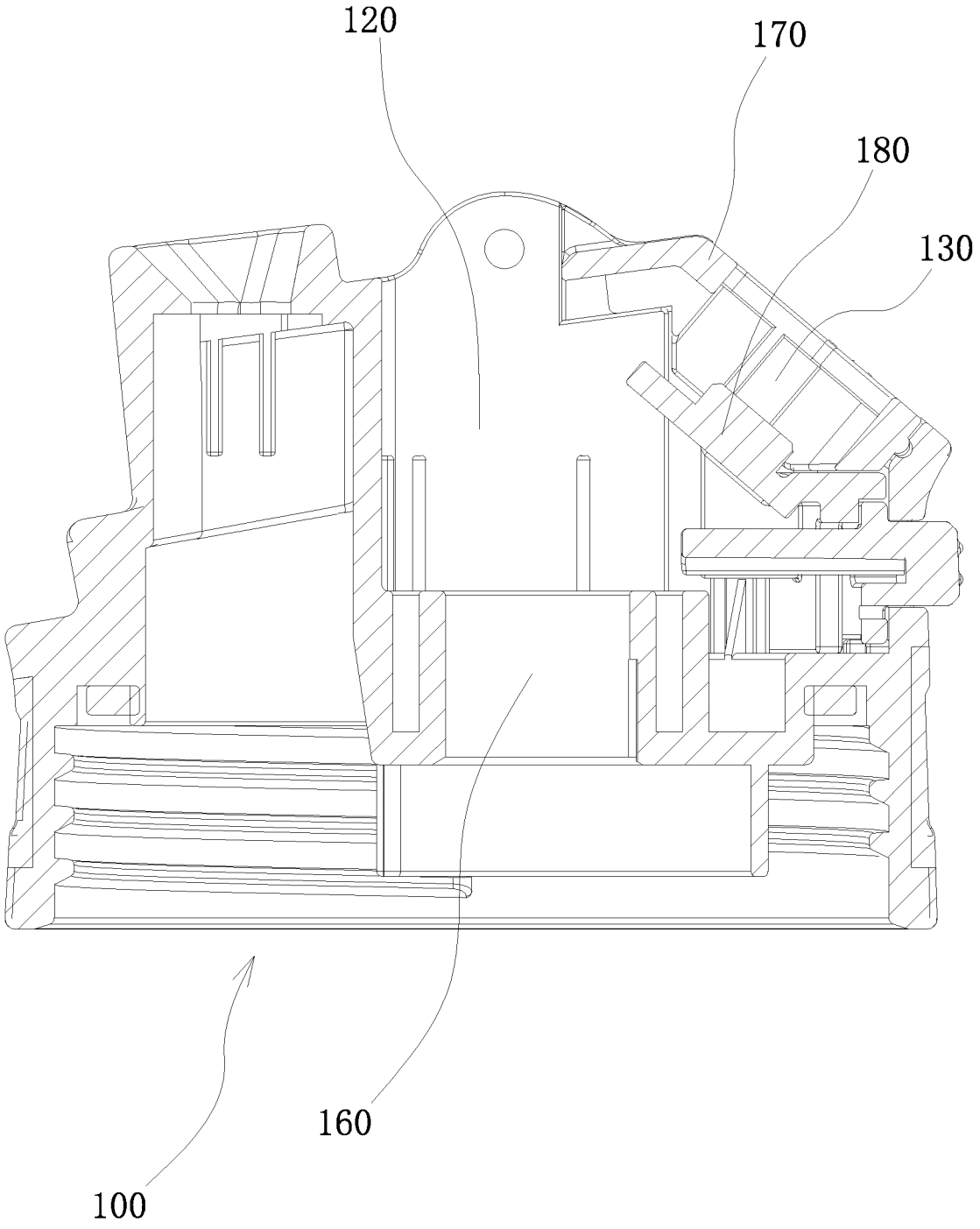
FIG. 6 is a structural schematic diagram of a lid body of the present invention.
Figure 7:
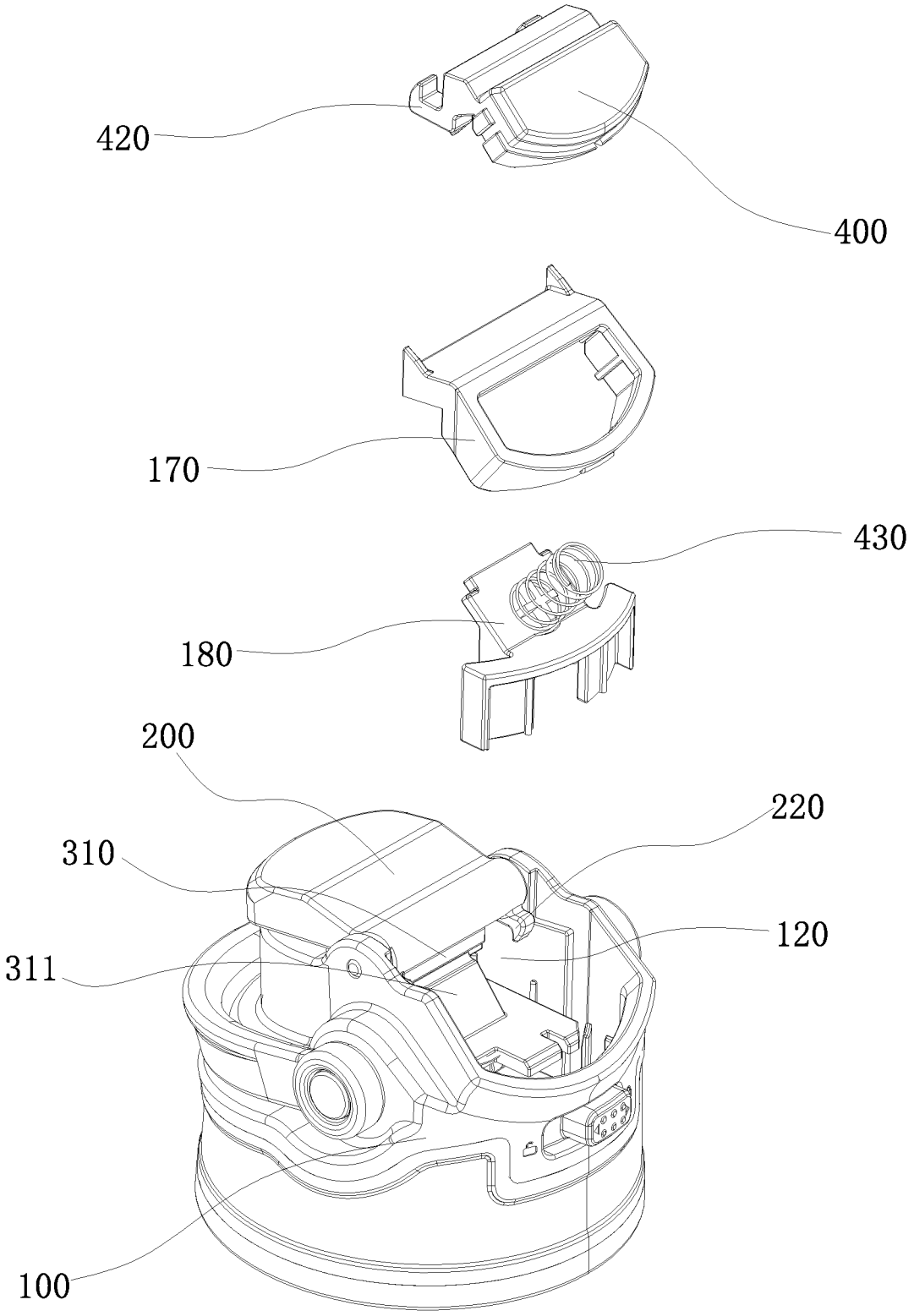
FIG. 7 is an exploded view of a structure of a button, a button mounting seat and a fixed plate of the present invention.
Figure 8:
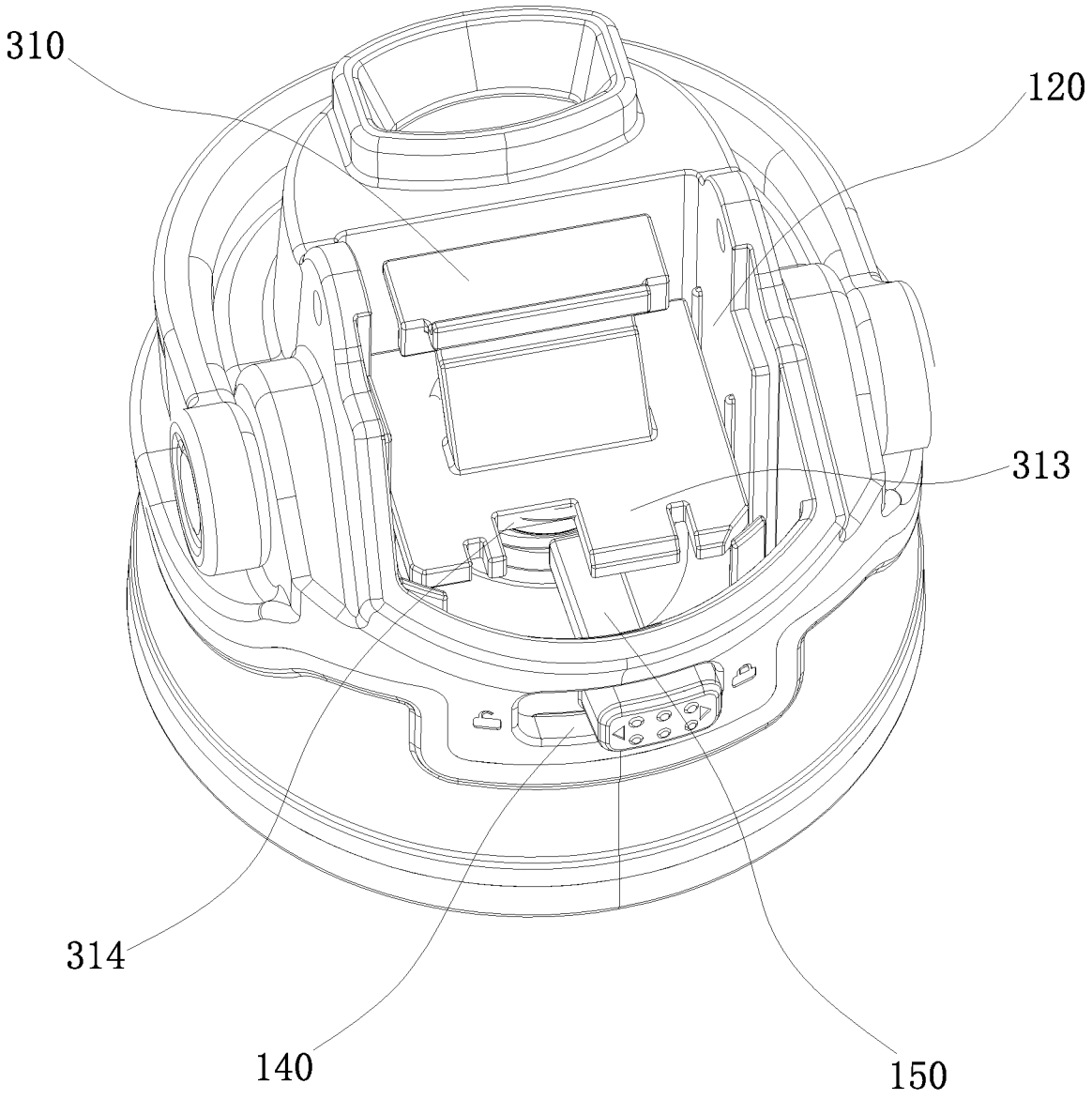
FIG. 8 is a schematic diagram of a connecting relation between a stop dog and a baffle of the present invention.
Figure 9:
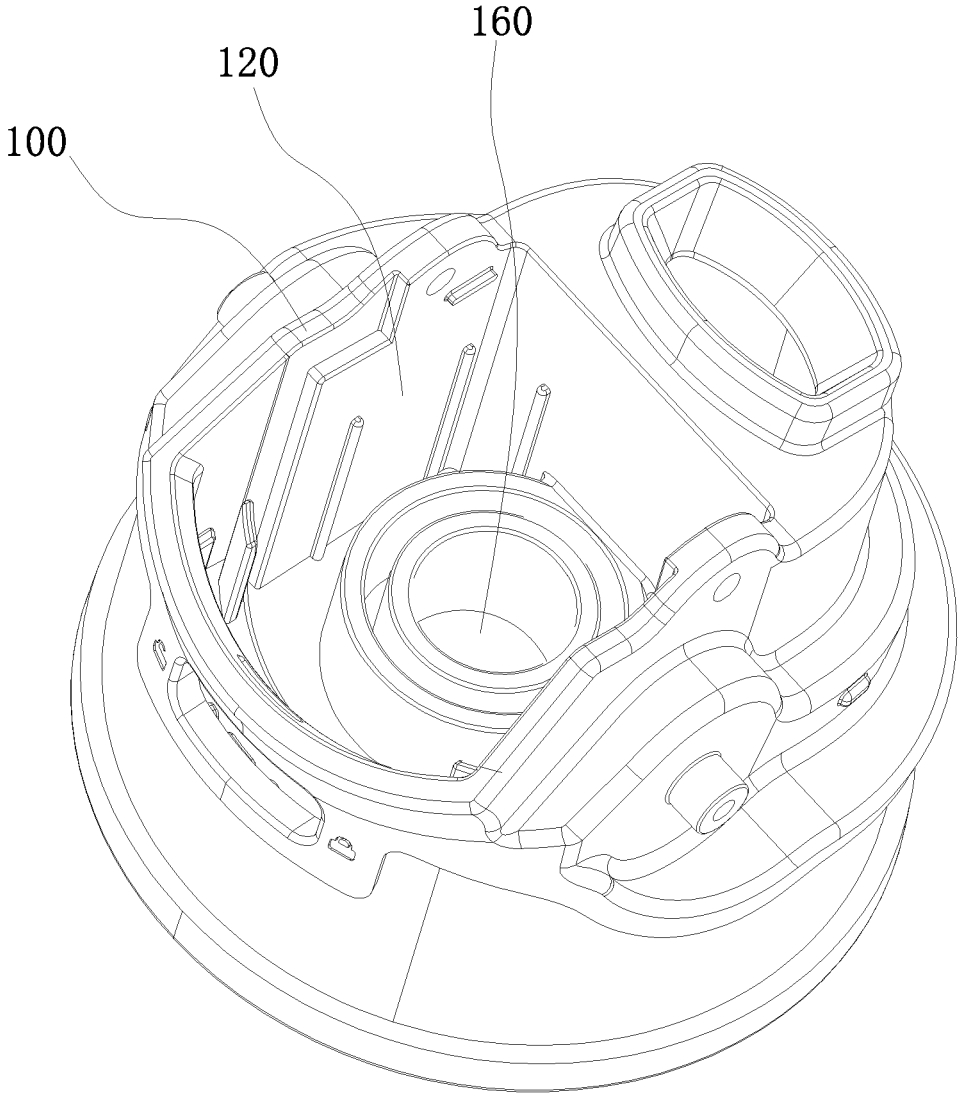
FIG. 9 is an axonometric diagram of a lid body of the present invention.
Figure 10:
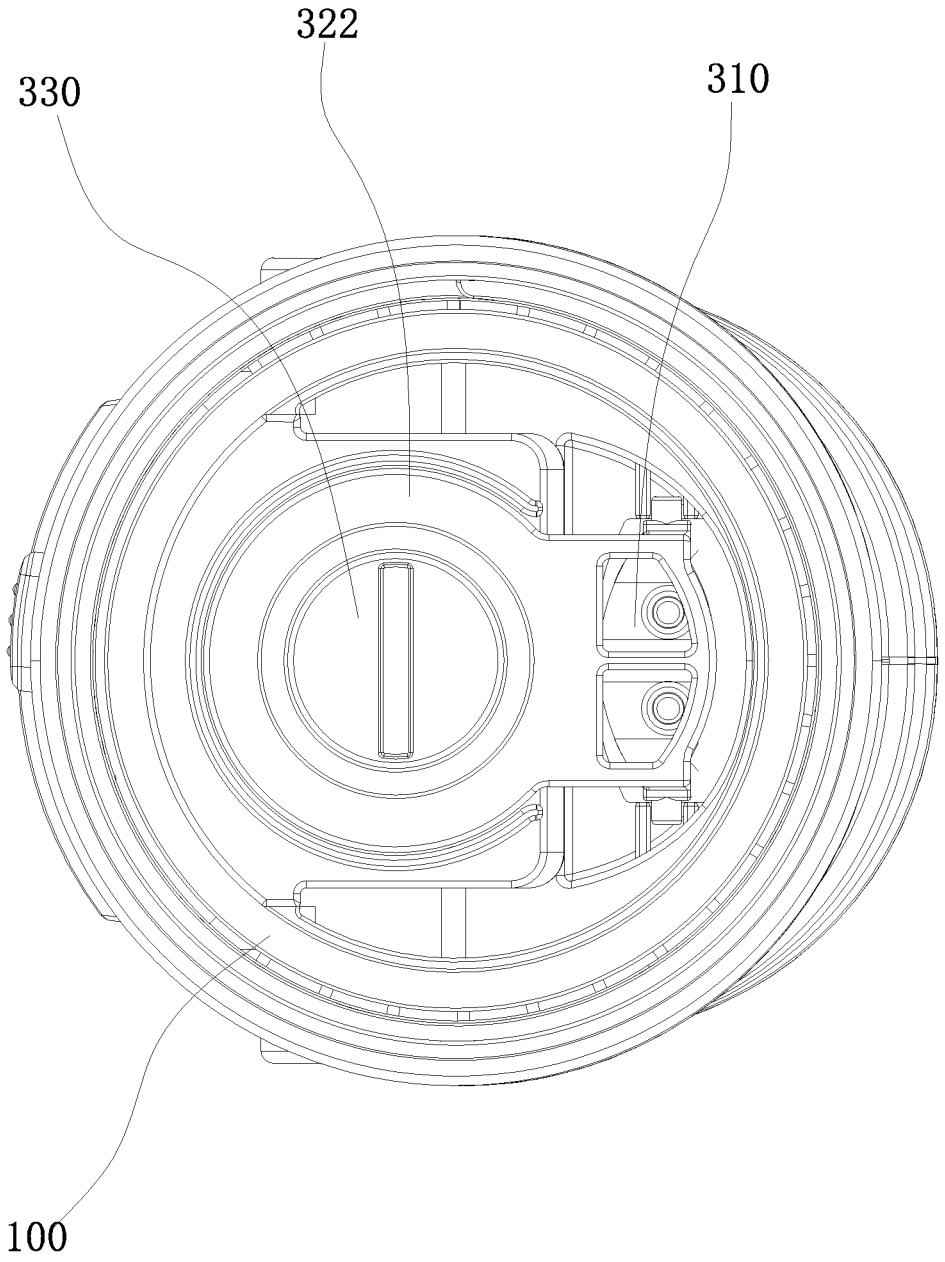
FIG. 10 is an upward view of a push type cup lid of the present invention.
Figure 11:
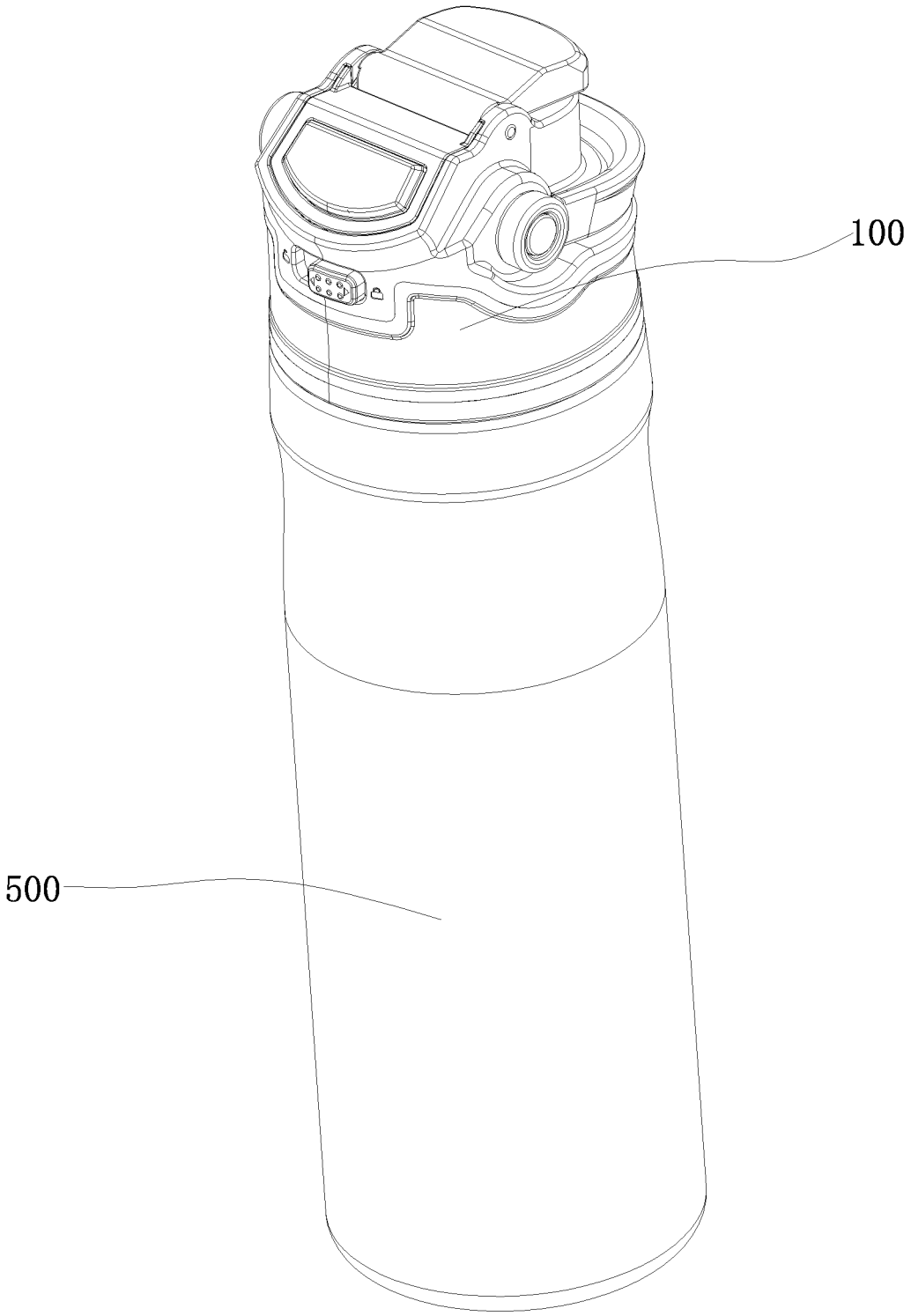
FIG. 11 is a schematic diagram of a cup of the present invention.
Figure 12:
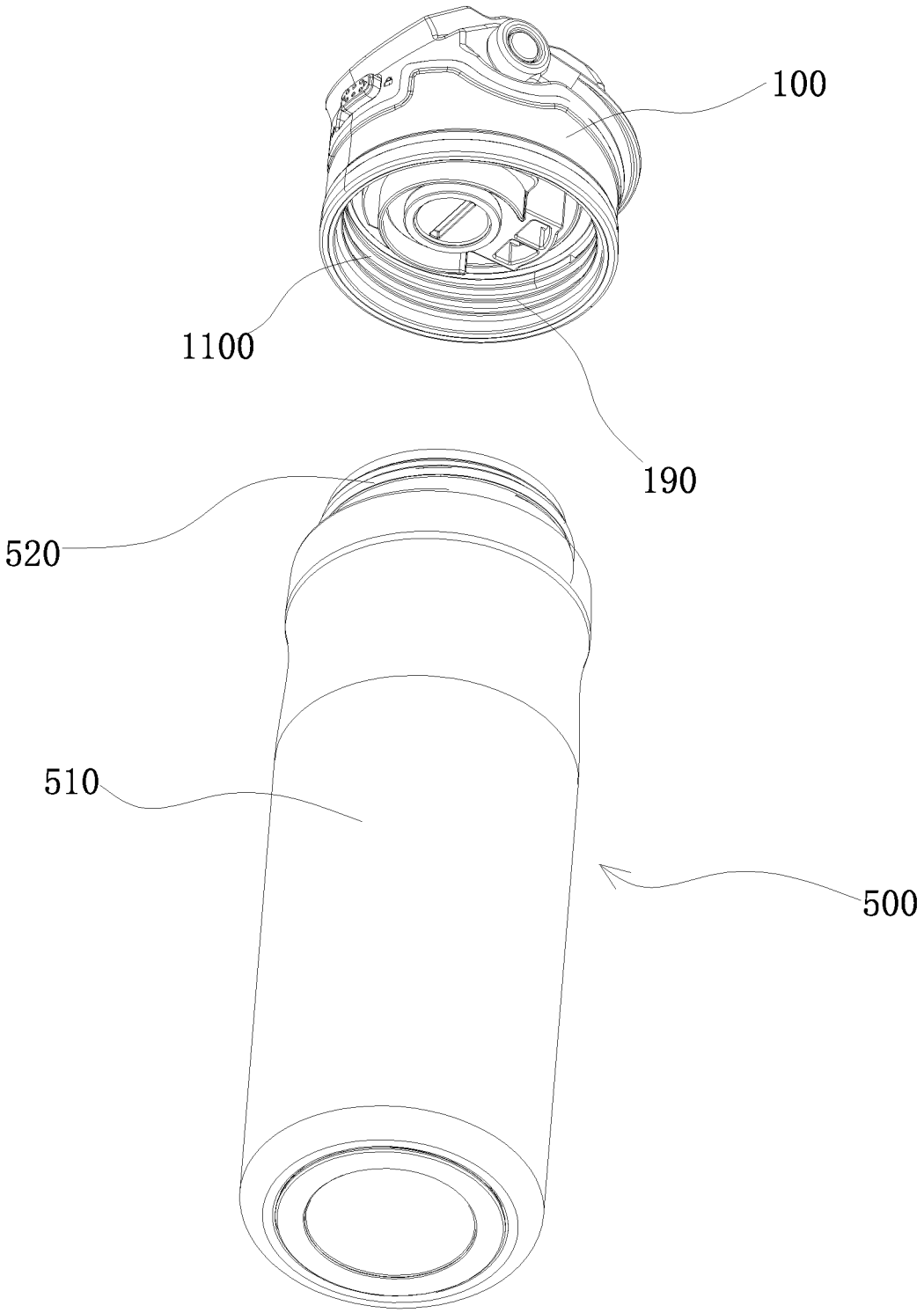
FIG. 12 is an exploded view of a structure of a cup body and a lid body of the present invention.
Figure 13:
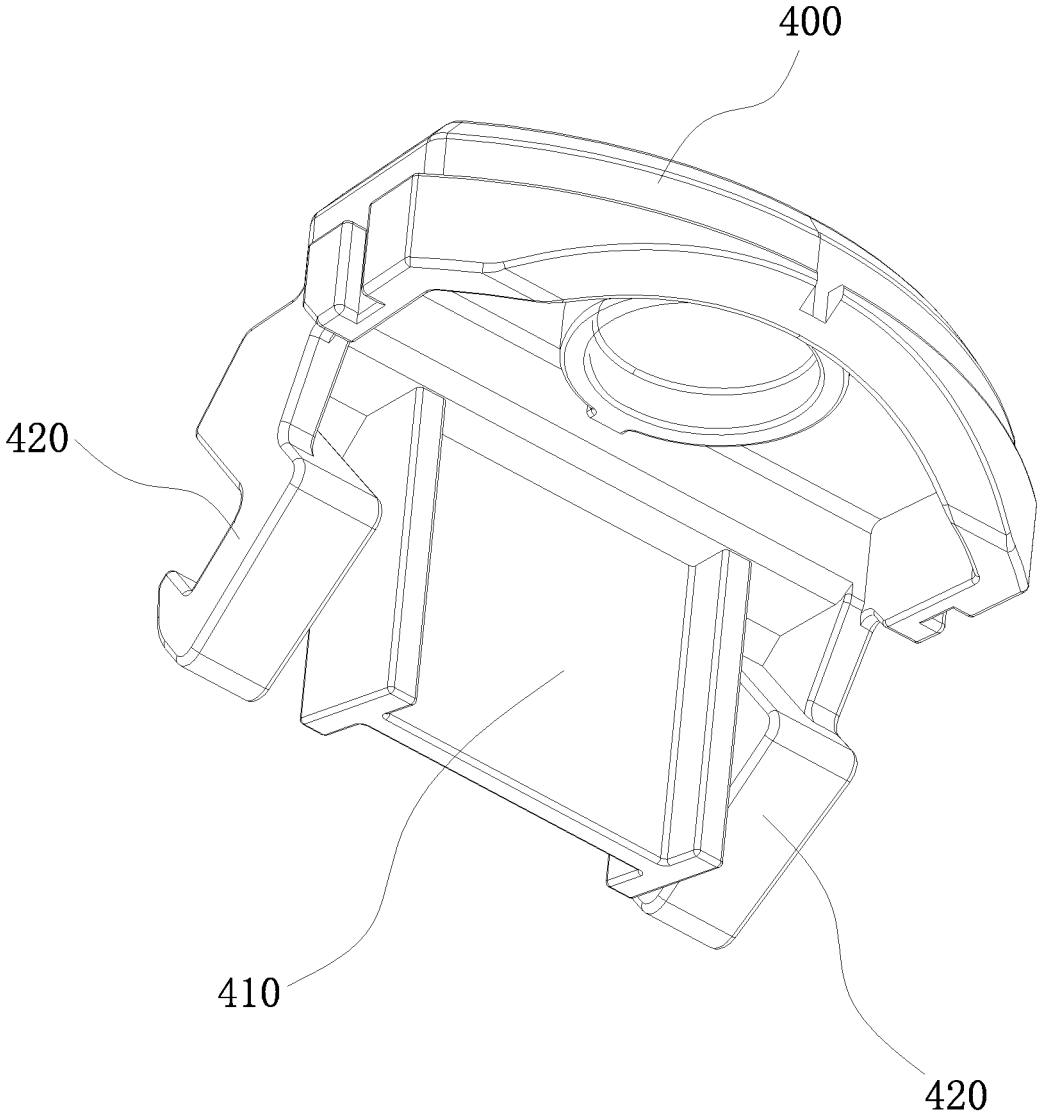
FIG. 13 is a structural schematic diagram of a button of the present invention.

In the drawings, 100, lid body; 110, water outlet; 120, first mounting cavity; 130, second mounting cavity; 140, strip-type groove; 150, stop dog; 160, guide hole; 170, button mounting seat; 180, fixed plate; 190, internal thread; 1100, third seal ring; 200, flip-top lid; 210, articulated shaft; 220, second hook; 230, torsional spring; 300, sealing assembly; 310, connecting rod; 311, bevel portion; 312, connecting rod reset spring; 313, baffle; 314, notch portion; 315, threaded hole; 316, guide portion; 320, sealing seat; 321, sealing element; 322, connecting plate; 330, connecting screw; 340, first seal ring; 350, second seal ring; 400, button; 410, push block; 420, first hook; 430, button reset spring; 500, cup body; 510, cup cavity; 520, external thread.

DETAILED DESCRIPTION OF THE INVENTION

Specific embodiments of the present invention are described below, and further description on the technical scheme of the present invention is made below in combination with the drawings. The present invention is not limited to the embodiments.

As shown in FIG. 1 to FIG. 10, a push type cup lid may be used on an outdoor cup, a sports cup, an insulation cup or other cups provided with cup lid structures. The cup lid includes a lid body 100, a flip-top lid 200 for covering a water outlet 110, a sealing assembly 300 for plugging the water outlet 110 and a button 400.

As shown in FIG. 1, FIG. 2, FIG. 4 and FIG. 7, the lid body 100 is connected with the cup body 500. As a main body structure of the cup lid, the lid body 100 is provided with the water outlet 110. A liquid in the cup may flow out from the water outlet 110. The flip-top lid 200 is rotatably mounted on the lid body 100, the flip-top lid 200 turned down may cover the water outlet 110 and the flip-top lid 200 may cover the upper side of the water outlet 110, so that the water outlet 110 may be closed when the cup lid is in an opened state, and foreign matters or dust may further be prevented from falling into the water outlet 110.

As shown in FIG. 1 to FIG. 6, the sealing assembly 300 may move in the lid body 100, and the sealing assembly 300 may plug the lower side of the water outlet 110. In the closed state, the sealing assembly 300 may plug the water outlet 110 from bottom to top, and the flip-top lid 200 can cover the upper side of the water outlet 110, so that the upper side and the lower side of the water outlet 110 may be sealed. The cup lid may obtain a better insulation effect due to the double structure of plugging the water outlet 110. Furthermore, it may be further reliably ensured that the water outlet 110 does not leak water.

The button 400 is an element for opening the cup lid. Both the sealing assembly 300 and the flip-top lid 200 are in linked connection with the button 400. The button 400 may be pressed. When the button 400 is pressed, the sealing assembly 300 is separated from the water outlet 110, and meanwhile, the flip-top lid 200 may be opened. Therefore, the sealing assembly 300 and the flip-top lid 200 may be opened at the same time when the button 400 is pressed. When the button 400 is reset to bounce, the flip-top lid 200 may be closed manually, so that the flip-top lid 200 covers the water outlet 110. The sealing assembly 300 further plugs the water outlet 110 again. The sealing assembly 300 and the flip-top lid 200 may act simultaneously by pressing one button 400, so that it is more convenient to use, and the cup lid may be opened with a single hand.

As shown in FIG. 1 to FIG. 6, the sealing assembly 300 includes a connecting rod 310 in linked connection with the button 400 and a sealing seat 320 for plugging the water outlet 110. The connecting rod 310 is movably mounted on the lid body 100 and when the button 400 is pressed, it may drive the connecting rod 310 to act, and the sealing seat 320 is connected with the connecting rod 310. The sealing seat 320 is movably arranged below the water outlet 110. When the connecting rod 310 acts, it may drive the sealing seat 320 to plug the water outlet 110 or drive the sealing seat 320 to be separated from the water outlet 110.

As shown in FIG. 1 to FIG. 10, based on the implementation mode, the upper end of the sealing seat 320 is provided with a sealing element 321 for plugging the water outlet 110. The sealing element 321 may be a rubber piece or a silica gel piece or other sealing elements. The lower end of the sealing seat 320 is provided with a connecting plate 322, and the connecting screw 330 penetrates through the connecting plate 322 and is screwed into the threaded hole 315 in the bottom of the connecting rod 310, so that the connecting plate 322 and the bottom of the connecting rod 310 are fixed together; in order to ensure sealing between the bottom of the connecting rod 310 and the connecting plate 322, a first seal ring 340 is arranged between the bottom of the connecting rod 310 and the connecting plate 322, thereby playing a sealing and waterproofing role; when the connecting rod 310 ascends vertically, it may drive the sealing seat 320 to ascend vertically via the connecting plate 322. The ascending sealing seat 320 may plug the water outlet 110 via the sealing element 321.

It is to be noted that the connecting rod 310 and the sealing seat 320 on the sealing assembly 300 may be screwed out via the connecting screw 330, so that the connecting rod 310 and the sealing seat 320 may be connected quickly and conveniently, and it is convenient to clean the sealing assembly. Specifically speaking, a lower end surface of the connecting screw 330 is provided with a notch, through which the connecting screw may be screwed out smoothly, so that it is convenient to clean interior of the sealing assembly 300.

The lid body 100 is provided with the first mounting cavity 120, the first mounting cavity 120 is formed along the axial direction of the lid body 100, the axial direction of the first mounting cavity 120 may be regarded as a vertical direction, the connecting rod 310 is mounted in the first mounting cavity 120 and may move up and down along the vertical direction, and the button 400 may push the connecting rod 310 to move downwards when being pressed, and the when the connecting rod 310 moves downwards, it may drive the sealing seat 320 to be separated from the water outlet 110.

It is to be noted that as the sealing seat 320 is located in the lid body 100 and the sealing seat 320 obstructs and plugs the water outlet 110 from bottom to top, it is hidden in structure and relatively good in sealing effect. No matter how the cup flips, the water outlet 110 may be tightly plugged, which is not easily interfered by an external force or an external factor.

Preferably, an inner wall of a cavity corresponding to the first mounting cavity 120 may be provided with a vertical guide bar to guide movement of the connecting rod 310. When the connecting rod 310 moves, it may drive the sealing seat 320 to move vertically together. When the connecting rod 310 ascends along the vertical direction, the sealing seat 320 may ascends and plugs the lower side of the water outlet 110. When the connecting rod 310 descends along the vertical direction, the sealing seat 320 may descend vertically to be separated from the water outlet 110 quickly, so that the water outlet 110 is communicated with the cup cavity 510 of the cup body 500.

In order to better guide vertical movement of the connecting rod 310, the lid body 100 is provided with a guide hole 160 located in the bottom of the first mounting cavity 120, and the guide hole 160 is communicated with the first mounting cavity 120. The connecting rod 310 is provided with a cylindrical or axial guide portion 316, and the guide portion 316 may just penetrate through the guide hole 160, so that when the connecting rod 310 moves, it may move axially along the guide hole 160. The axial direction of the guide hole 160 is consistent with that of the water outlet 110. Thus, the moving direction of the connecting rod 310 may be guided in a forced manner, so that the connecting rod 310 may only ascend and descend vertically.

In order to keep waterproof sealing between the connecting rod 310 and the lid body 100, the guide portion 316 is specially provided with a second seal ring 350, the second seal ring 350 is located in the guide hole 160, and it may ensured that the connecting rod 310 and the lid body 100 are sealed by the second seal ring 350.

In order to reset the sealing seat 320 automatically to seal the water outlet 110 when the button 400 is loosened, the first mounting cavity 120 is specially provided with the connecting rod reset spring 312 internally, the bottom of the first mounting cavity 120 is provided with a spring seat, the connecting rod reset spring 312 is sleeved with the connecting rod 310, the lower end of the connecting rod reset spring 312 is in abutting connection with the spring seat at the bottom of the first mounting cavity 120, and the upper end of the connecting rod reset spring 312 is in abutting connection with the connecting rod 310.

When the button 400 is pressed to descend the connecting rod 310, the connecting rod reset spring 312 is compressed to accumulate a force. When the button 400 is loosened, the connecting rod reset spring 312 pushes the connecting rod 310 to move upwards, so that the sealing seat 320 moves upwards to plug the water outlet 110, and therefore, the connecting rod 310 is provided with a reset power. When the sealing seat 320 plugs the water outlet 110, the connecting rod reset spring 312 may further apply an acting force to the sealing seat 320 towards the water outlet 110 via the connecting rod 310, so that the sealing seat 320 plugs the water outlet 110 tightly.

As shown in FIG. 1, the lid body 100 is internally provided with a button mounting seat 170, the button mounting seat 170 is provided with a second mounting cavity 130, the second mounting cavity 130 is formed obliquely, the button 400 is assembled in the button mounting seat 170 and may move in the second mounting cavity 130, and when the button 400 is pressed, it may move in the second mounting cavity 130, and the moving direction of the button 400 is inclined to the moving direction of the connecting rod 310.

It is to be noted here that the moving direction of the button 400 which is pressed is inconsistent with the moving direction of the connecting rod 310 because besides driving the connecting rod 310 to act, the button 400 further needs to unlock the flip-top lid 200. If the moving direction of the button 400 is arranged to move obliquely, it is favorable for the button 400 to trigger the connecting rod 310 and the flip-top lid 200 to act at the same time.

In order to reset the button 400 automatically when the button is loosened, the second mounting cavity 130 is internally provided with a button reset spring 430. The bottom of the second mounting cavity 130 is provided with the fixed plate 180. One end of the button reset spring 430 is in abutting connection with the button 400 and the other end thereof is in abutting connection with the fixed plate 180. When the button 400 is pressed, the button reset spring 430 is compressed to accumulate a force. After the button 400 is loosened, the button reset spring 430 may jack the button 400, so that the button 400 is reset.

As shown in FIG. 2, FIG. 3, FIG. 4, FIG. 5, FIG. 7 and FIG. 13, the connecting rod 310 is provided with a bevel portion 311, the button 400 is provided with a push block 410 facing the connecting rod 310, the push block 410 is in abutting connection with the bevel portion 311, the bevel portion 311 is provided with a first bevel, the push block 410 is provided with a second bevel, the first bevel and the second bevel are matched together, and when the button 400 is pressed along the inclination direction, the push block 410 pushes the bevel portion 311, so that the connecting rod 310 descends vertically.

Preferably, an angle of a bevel of the bevel portion 311 may be arranged between 15° and 90°. In the actual structure, the angle of a bevel of the bevel portion 311 may be about 45°, so that the button 400 may push the connecting rod 310 to move vertically more smoothly.

In order to make the obliquely moving button 400 push the vertically ascending and descending connecting rod 310, the structure of the bevel portion 311 and the push block 410 is specially adopted to convert an inclination movement into a vertical movement, so that the button 400 may unlock the flip-top lid 200 smoothly and push the sealing seat 320 to descend when moving along an optimum unlocking path.

As shown in FIG. 1, the flip-top lid 200 is provided with an articulated shaft 210, the articulated shaft 210 is connected with the lid body 100, and the flip-top lid 200 may rotate around the articulated shaft 210 to open the water outlet 110 or cover the water outlet 110.

As shown in FIG. 1, FIG. 3, FIG. 5 and FIG. 7, the button 400 is provided with a first hook 420, and the flip-top lid 200 is provided with a second hook 220. When the button 400 is not pressed, the flip-top lid 200 covers the water outlet 110 and the first hook 420 hooks the second hook 220, and at the time, the button 400 may lock the flip-top lid 200 so as to limit rotation of the flip-top lid 200. When the button 400 is pressed, the first hook 420 moves obliquely along with the button 400, and at the time, the first hook 420 and the second hook 220 are separated. The flip-top lid 200 which is not locked by the button 400 may rotate freely.

In order to make the flip-top lid 200 turn over automatically after being unlocked, the articulated shaft 210 is specially provided with a torsional spring 230, and two ends of the torsional spring 230 are in abutting connection with the flip-top lid 200 and the lid body 100 respectively. Once the button 400 is pressed, the first hook 420 and the second hook 220 are separated, so that the torsional spring 230 may drive the flip-top lid 200 to turn over automatically.

As shown in FIG. 1 to FIG. 10, a working principle of the push type cup lid is as follows: when the button 400 is pressed, it moves obliquely, the first hook 420 and the second hook 220 are separated, so that locking of the flip-top lid 200 is relieved, and meanwhile, the push block 410 of the button 400 pushes the bevel portion 311, so that the connecting rod 310 descends; the flip-top lid 200 is opened automatically under the action of the torsional spring 230, and when the connecting rod 310 descends, it drives the sealing element 321 on the sealing seat 320 to be separated from the water outlet 110, and at the time, the upper side and the lower side of the water outlet 110 are fully opened; when the button 400 is loosened, the button reset spring 430 pushes the button 400 to reset, the connecting rod reset spring 312 pushes the connecting rod 310 to ascend, so that the sealing element 321 on the sealing seat 320 plugs the water outlet 110, and then the flip-top lid 200 is covered manually. The second hook 220 of the flip-top lid 200 reset is matched with the first hook 420 so as to lock the flip-top lid 200.

As shown in FIG. 1, FIG. 2, FIG. 3, FIG. 4, FIG. 5, FIG. 7 and FIG. 8, the cup lid further has locking and unlocking functions. In a locked state of the cup lid, the button 400 may not be pressed, and in the unlocked state of the cup lid, the button 400 may be pressed, so that the sealing seat 320 and the flip-top lid 200 are opened.

A peripheral surface of the lid body 100 is provided with a strip-type groove 140 along a transverse or horizontal direction, the strip-type groove 140 is internally provided with a stop dog 150 capable of sliding along the strip-type groove 140, the stop dog 150 is an shift block structure with unlocking and locking functions, the connecting rod 310 is provided with a baffle 313 extending towards the peripheral direction of the lid body 100, the end portion of the stop dog 150 extends towards the baffle 313 and extends to the lower side of the baffle 313, and therefore, in the locked state, the stop dog 150 may block the baffle 313, so that the connecting rod 310 may not move downwards. The connecting rod 310 and the button 400 are in linked connection, so that when the connecting rod 310 is locked, the button 400 may not be pressed.

The baffle 313 is provided with a notch portion 314 matched with the stop dog 150 in shape, the stop dog 150 may slide to the locking position in abutting connection with the baffle 313, and at the time, the cup lid is in the locked state, or the stop dog 150 may slide to the unlocking position corresponding to the notch portion 314, and at the time, the cup lid is in the unlocked state. When the stop dog 150 is in the locking position, the stop dog 150 may lean against the baffle 313, so that the connecting rod 310 may not move downwards, and thus, movement of the button 400 is limited by the connecting rod 310. When the stop dog 150 is located below the notch portion 314, the stop dog 150 may not block the baffle 313, so that the connecting rod 310 may move downwards.

It is to be supplemented that the stop dog 150 is in abutting connection with the fixed plate 180, and the fixed plate 180 may block the stop dog 150 to limit movement thereof towards the lid body 100, so that the stop dog 150 may only move along the strip-type groove 140.

As shown in FIG. 1, FIG. 2, FIG. 4, FIG. 11 and FIG. 12, a cup includes a cup body 500 and the push type cup lid. The cup may be arranged as an outdoor cup, a sports cup, an insulation cup or other cups with cup lid structures. The cup body 500 is provided with a cup cavity 510 for storing a liquid, wherein the push type cup lid is connected with the cup body 500 and covers the cup cavity 510, and the liquid in the cup cavity 510 may flow out from the water outlet 110 in the cup lid.

The cup body 500 and the lid body 100 are in threaded connection, a rim of a cup of the cup body 500 is provided with an external thread 520, the lid body 100 is provided with an internal thread 190, and the lid body 100 is detachably connected with the cup body 500 via the internal thread 190 and the external thread 520; the lid body 100 is internally provided with a third seal ring 1100, the third seal ring 1100 is in abutting connection with the end port of the cup body 500; when the cup body 500 and the lid body 100 are tightened, the third seal ring 1100 is located between the cup body 500 and the lid body 100 so as to seal a joint therebetween, thereby avoiding water leakage.

When the button 400 is not pressed, the sealing element 321 on the sealing seat 320 plugs the lower side of the water outlet 110 to direct obstruct the water outlet 110 in the cup lid. When the cup cavity 510 stores hot water internally, an inner air pressure may be assistant to push the sealing element 321 to plug the water outlet 110, so that the sealing effect and reliability when the cup lid is closed are further improved.

It is to be noted that all directional indications (for example, upper, lower, left, right, front, back and the like) in the embodiment of the present invention are merely used for explaining relative position relations, moving conditions and the like among components in a certain special gesture (as shown in the drawings). If the special gesture changes, the directional indications change correspondingly.

In addition, terms 'first', 'second', 'one' and the like are only used for a description purpose rather than being construed to indicate or imply relative importance or implicitly indicate the quantity of indicated technical features. Thus, features defining 'first', 'second' and the like can expressively or implicitly include at least one feature. In the description of the present invention, unless otherwise specified, 'a plurality of' means at least two, for example, two, three and the like.

In the present invention, unless otherwise expressly stated and defined, terms 'connect', 'fix' and the like shall be understood in a board sense, for example, 'fix' may be fixed connected or detachably connected or integrally connected; they may be mechanically connected or electrically connected; they may be directly connected or connected via an intermediate, or they may communication of two components insides or an interactive relation of the two components, unless otherwise specified. Those skilled in the art can understand specific meaning of the terms in the present invention under specific circumstances.

In addition, the technical schemes of the embodiments of the present invention may be combined one another based on implementation by those of ordinary skill in the field. When the technical schemes contradict each other in combination or may not be realized, it is to be considered that there is no combination of the technical schemes, which shall not fall into the protection scope of the present invention.

What is claimed is:

1. A push type cup lid, characterized by comprising:

a lid body provided with a water outlet;

a flip-top lid for covering the water outlet, the flip-top lid being rotatably connected with the lid body;

a sealing assembly for plugging the water outlet, the sealing assembly being movably connected with the lid body; and a button, the button being arranged on the lid body in a pressed manner, both the sealing assembly and the flip-top lid being in linked connection with the button, when the button is not pressed, the flip-top lid covering the water outlet and the sealing assembly plugging the water outlet, and when the button is pressed, the flip-top lid turning back and the sealing assembly being separated from the water outlet;

the sealing assembly comprises a connecting rod in linked connection with the button and a sealing seat plugging the water outlet, wherein the connecting rod is movably connected with the lid body, the sealing seat is connected with the connecting rod, and when the button is pressed, the button drives the sealing seat to be separated from the water outlet via the connecting rod;

the lid body is provided with a first mounting cavity, and the connecting rod is assembled in the first mounting cavity and moves along an axial direction of the first mounting cavity;

the lid body is provided with a guide hole, the connecting rod is provided with a guide portion, and the guide portion penetrates through the guide hole movably.

2. The push type cup lid as claimed in claim 1, characterized in that the lid body is further provided with a second mounting cavity, and the button is assembled in the second mounting cavity and moves along a direction inclined to a moving direction of the connecting rod.

3. The push type cup lid as claimed in claim 2, characterized in that the connecting rod is provided with a bevel portion, the button is provided with a push block, the push block is in abutting connection with the bevel portion, and when the button is pressed along an inclination direction, the push block pushes the bevel portion, so that the connecting rod descends vertically.

4. The push type cup lid as claimed in claim 1, characterized in that one end of the sealing seat is provided with a sealing element located under the water outlet, the other end of the sealing seat is provided with a connecting plate extending towards a direction of the connecting rod, the connecting plate is fixedly connected with the connecting rod, and the sealing element plugs the water outlet.

5. The push type cup lid as claimed in claim 3, characterized in that the flip-top lid is provided with an articulated shaft, the articulated shaft is connected with the lid body, and the flip-top lid can rotate around the articulated shaft so as to open the water outlet or cover the water outlet.

6. The push type cup lid as claimed in claim 5, characterized in that the button is provided with a first hook, the flip-top lid is provided with a second hook, when the flip-top lid covers the water outlet, the first hook hooks the second hook to limit turning back of the flip-top lid, and when the button is pressed, the first hook loosens the second hook so as to relieve locking of the flip-top lid.

7. The push type cup lid as claimed in claim 6, characterized in that the articulated shaft is provided with a torsional spring connected with the lid body, and when the first hook loosens the second hook, the torsional spring drives the flip-top lid to rotate around the articulated shaft so as to open the water outlet.

8. The push type cup lid as claimed in claim 3, characterized in that a connecting rod reset spring for jacking the connecting rod is mounted between the connecting rod and the lid body, and one end of the connecting rod reset spring is in abutting connection with the connecting rod and the other end thereof is in abutting connection with the lid body.

9. The push type cup lid as claimed in claim 1, characterized in that a peripheral surface of the lid body is provided with a strip-type groove, the strip-type groove is internally provided with a stop dog capable of sliding along the strip-type groove, the connecting rod is provided with a baffle extending towards a direction of the peripheral surface of the lid body, the baffle is provided with a notch portion matched with the stop dog, the stop dog can slide to a locking position in abutting connection with the baffle or the stop dog can slide to an unlocking position corresponding to the notch portion, and when the stop dog is located in the locking position, the stop dog limits movement of the button via the connecting rod.

10. The push type cup lid as claimed in claim 4, characterized in that the sealing assembly further comprises a connecting screw, the connecting rod is provided with a threaded hole, and the connecting screw is connected with the threaded hole and abuts against the connecting plate so as to lock the connecting rod and the connecting plate.

11. The push type cup lid as claimed in claim 3, characterized in that the lid body is provided with a button mounting seat, the second mounting cavity is located in the button mounting seat, and the button is assembled in the button mounting seat.

12. The push type cup lid as claimed in claim 11, characterized in that the second mounting cavity is provided with a button reset spring for jacking the button, the lid body is provided with a fixed plate located at a bottom of the second mounting cavity, and one end of the button reset spring is in abutting connection with the button and the other end thereof is in abutting connection with the fixed plate.

13. The push type cup lid as claimed in claim 4, characterized in that a position where the connecting plate and the connecting rod are matched is provided with a first seal ring.

14. The push type cup lid as claimed in claim 1, characterized in that the guide portion is sleeved with a second seal ring located between the guide portion and the guide hole.

15. A cup, characterized by comprising:

a cup body provided with a cup cavity, wherein the push type cup lid as claimed in claim 1 is connected with the cup body and covers the cup cavity.

16. The cup as claimed in claim 15, characterized in that a rim of the cup of the cup body is provided with an external thread, the lid body is provided with an internal thread, and the lid body is detachably connected with the cup body via the internal thread and the external thread.

17. The cup as claimed in claim 16, characterized in that the lid body is internally provided with a third seal ring, and the third seal ring is in abutting connection with an end port of the cup body.

* * * * *